US012721426B1

(12) United States Patent
Lin

(10) Patent No.: US 12,721,426 B1
(45) Date of Patent: Sep. 1, 2026

(54) BAR COUNTER FOR ABOVE-GROUND SWIMMING POOL

(71) Applicant: Zhipei Lin, Shenzhen (CN)

(72) Inventor: Zhipei Lin, Shenzhen (CN)

( * ) Notice: Subject to any disclaimer, the term of this patent is extended or adjusted under 35 U.S.C. 154(b) by 0 days.

(21) Appl. No.: 19/449,434

(22) Filed: Jan. 15, 2026

(30) Foreign Application Priority Data

Dec. 3, 2025 (CN) ..... 202522576573.5

(51) Int. Cl.
*A47B 5/02* (2006.01)
*A47B 13/08* (2006.01)
*A47B 13/16* (2006.01)
*A47B 37/04* (2006.01)

(52) U.S. Cl.
CPC ..... *A47B 5/02* (2013.01); *A47B 13/088* (2013.01); *A47B 13/16* (2013.01); *A47B 37/04* (2013.01)

(58) Field of Classification Search
CPC ..... A47B 5/02; A47B 13/088; A47B 13/16; A47B 37/04; A47B 23/00; A47B 23/02; A47B 23/025; A47B 9/20; A47B 2009/06; A47B 2009/065
See application file for complete search history.

(56) References Cited

U.S. PATENT DOCUMENTS 2,246,432 A * 6/1941 Cohen ..... B60N 3/007 108/47
4,059,248 A * 11/1977 Kuntz ..... A47H 27/00 248/228.6
4,089,276 A * 5/1978 Enos ..... B60S 5/00 5/119
4,850,282 A * 7/1989 Postic ..... A47B 23/04 108/47
4,893,363 A * 1/1990 Huff ..... E04H 4/144 4/496
6,474,244 B1 * 11/2002 Karpinski ..... E04H 4/14 108/42
6,854,402 B2 * 2/2005 DuBarry ..... A47B 45/00 108/146
7,661,374 B2 * 2/2010 Mullen, III ..... A47B 1/02 108/157.15

(Continued)

FOREIGN PATENT DOCUMENTS

DE 202024102871 U1 * 9/2024 ..... B65D 25/22

*Primary Examiner* — Hanh V Tran
(74) *Attorney, Agent, or Firm* — Abd Almonem Doolaanea

(57) ABSTRACT

A bar counter for an above-ground swimming pool includes hooks spaced apart on opposite sides of a countertop; a support adjustment assembly is mounted at a lower end of the hook, a movable adjustment rod is slidably mounted on an inner side of the support adjustment assembly, and a limiting portion cooperating with the movable adjustment rod is disposed inside the support adjustment assembly. By providing the support adjustment assembly, the limiting portion and other related mechanisms, the bar counter can cooperate with the hooks on the countertop to adjust an extension length of the movable adjustment rod, such that the countertop can be stably mounted on above-ground swimming pools of different shapes and specifications. This effectively solves the problems that existing swimming pool bar counter mounting mechanisms are not adjustable, and are difficult to adapt to various shapes of above-ground swimming pools.

8 Claims, 6 Drawing Sheets

(56) References Cited

U.S. PATENT DOCUMENTS

| | | | | |
|---|---|---|---|---|
| 8,857,347 | B1 * | 10/2014 | Liu | A47B 5/02 108/47 |
| 9,675,169 | B1 * | 6/2017 | Lai | A47B 1/05 |
| 9,814,305 | B2 * | 11/2017 | Brus | A47G 7/044 |
| 10,098,450 | B1 * | 10/2018 | Brewer | A47D 3/00 |
| 10,201,232 | B2 * | 2/2019 | Melaragno | A47B 23/02 |
| 10,443,640 | B2 * | 10/2019 | Balk | F16B 2/08 |
| 10,537,171 | B2 * | 1/2020 | Melaragno | A47B 5/04 |
| 10,786,073 | B1 * | 9/2020 | Dillard | F16B 5/004 |
| 10,806,247 | B1 * | 10/2020 | Chen | A47B 3/0913 |
| 10,840,849 | B2 * | 11/2020 | Belverio | A47B 23/001 |
| 10,918,202 | B1 * | 2/2021 | Sie | A47B 9/06 |
| 11,278,034 | B2 * | 3/2022 | Gonzalez | A47B 3/0818 |
| 11,311,103 | B1 * | 4/2022 | Wilson | A47B 9/00 |
| 11,969,086 | B2 * | 4/2024 | Christensen | A47B 5/02 |
| 12,344,433 | B2 * | 7/2025 | Eng | A47B 23/025 |
| 2004/0226486 | A1 * | 11/2004 | Simpson | A47B 13/16 108/47 |
| 2007/0101908 | A1 * | 5/2007 | Makita | A47B 5/02 108/47 |
| 2013/0319884 | A1 * | 12/2013 | Gomez | A47D 1/0081 248/274.1 |

* cited by examiner

BAR COUNTER FOR ABOVE-GROUND SWIMMING POOL

CROSS-REFERENCE TO RELATED APPLICATIONS

This application claims priority to Chinese Patent Application No. 2025225765735, filed on Dec. 3, 2025, which is hereby incorporated by reference in its entirety.

TECHNICAL FIELD

The present disclosure belongs to the field of swimming pool hanging tables, and in particular to a bar counter for an above-ground swimming pool.

BACKGROUND

Swimming pools are specialized venues for people to engage in swimming activities or hold competitions. Above-ground swimming pools are composed of large containers capable of being filled with water and are among the most common types of private swimming pools available on the market. Compared with in-ground swimming pools, above-ground swimming pools are more economical. At such above-ground swimming pools, people often wish to have refreshments such as cold beverages and food, or place additional personal belongings at the poolside. Accordingly, a bar counter designed for above-ground swimming pools is needed, so that swimmers can conveniently place or retrieve items without leaving the above-ground swimming pool.

In the prior art, conventional poolside bars are devices in which a platform is attached to an edge of the swimming pool, allowing for convenient placement or retrieval of items. However, in practical use, mounting mechanisms of the conventional pool bars are not adjustable, making them difficult to adapt to above-ground swimming pools of various shapes and specifications, and thus limiting their applicability.

Therefore, improvements have been made, and a bar counter for an above-ground swimming pool is provided.

SUMMARY

The present disclosure provides a bar counter for an above-ground swimming pool, so as to solve the technical problems mentioned in the above background.

In order to achieve the foregoing object, the present disclosure adopts the following technical solution:

a bar counter for an above-ground swimming pool, including hooks spaced apart on opposite sides of a countertop, where a support adjustment assembly is mounted at a lower end of the hook, a movable adjustment rod is slidably mounted on an inner side of the support adjustment assembly, and a limiting portion cooperating with the movable adjustment rod is disposed inside the support adjustment assembly.

As a preferred technical solution of the present disclosure, the countertop is formed by a plurality of spliced countertop panels assembled together on a horizontal plane.

As a preferred technical solution of the present disclosure, mounting plates are mounted at intervals at a bottom of the countertop, and the mounting plates cover splicing joints between adjacent spliced countertop panels.

As a preferred technical solution of the present disclosure, the spliced countertop panels are provided with storage recesses.

As a preferred technical solution of the present disclosure, a top of the hook is C-shaped, and the support adjustment assembly is detachably mounted at a lower end of a bottom of the hook.

As a preferred technical solution of the present disclosure, the support adjustment assembly includes a support rod, where the support rod is L-shaped and hollow inside, a top of the support rod is connected to the hook, a movable adjustment rod is slidably mounted inside a bottom of the support rod, and one side of the movable adjustment rod extends outward from the support rod and is provided with an abutting plate.

As a preferred technical solution of the present disclosure, the limiting portion includes a movable limiting block disposed inside the bottom of the support rod and pivotally mounted via a pivot shaft, a limiting tooth portion is disposed at an upper end of one side of the movable limiting block, and a bottom of the movable adjustment rod is provided with a first rack adapted to the limiting tooth portion.

As a preferred technical solution of the present disclosure, an adjustment knob is rotatably mounted on a side wall of the support rod, the adjustment knob is connected to an adjustment gear rotatably mounted inside the support rod, and a second rack adapted to the adjustment gear is disposed at the bottom of the movable adjustment rod along a side of the limiting tooth portion.

As a preferred technical solution of the present disclosure, a side of the movable limiting block away from the limiting tooth portion is provided with a first mounting portion, a second mounting portion is disposed at an upper portion inside the support rod at a position corresponding to the first mounting portion, and a spring is installed between the first mounting portion and the second mounting portion.

As a preferred technical solution of the present disclosure, a side of the abutting plate away from the movable adjustment rod is provided with a buffer pad, and a strap is further mounted on the abutting plate.

Compared with the prior art, the present disclosure has the following beneficial effects:

By providing the support adjustment assembly, the limiting portion and other structures, the bar counter can cooperate with the hooks on the countertop to adjust an extension length of the movable adjustment rod inside the support adjustment assembly, such that the countertop can be stably mounted on above-ground swimming pools of different shapes and specifications, thereby achieving strong applicability. This effectively solves the problems in the prior art that existing swimming pool bar counter mounting mechanisms are not adjustable, and are difficult to adapt to various unique shapes of above-ground swimming pools, resulting in low applicability.

Figure 1:
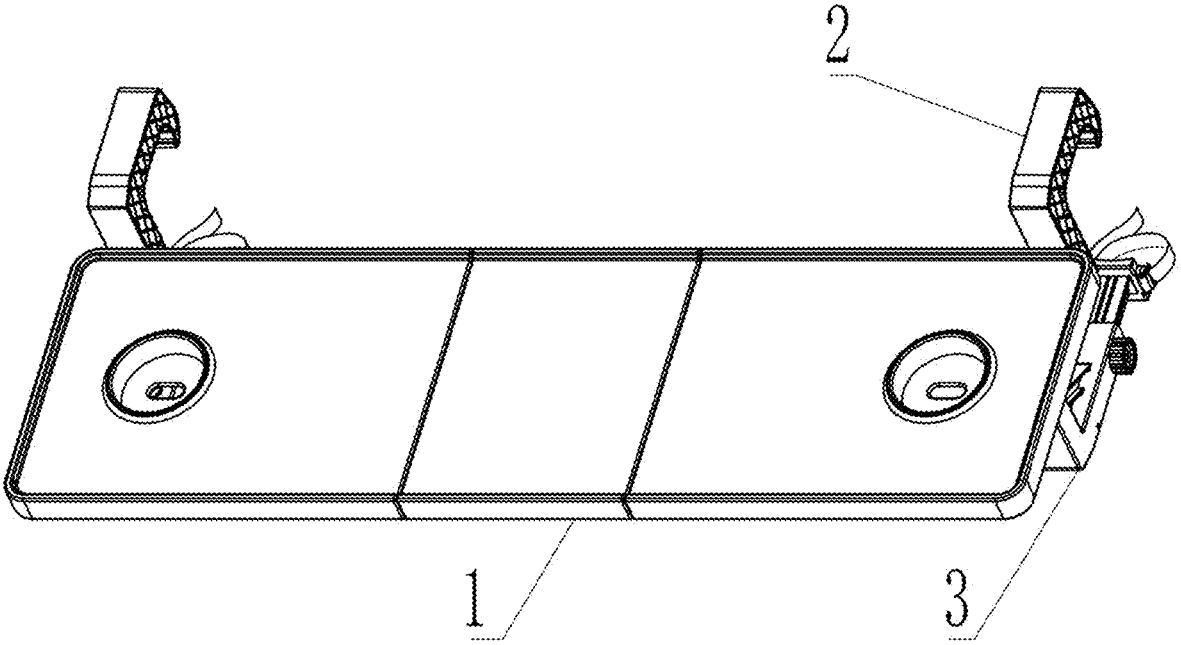
FIG. 1 is a first three-dimensional schematic structural diagram of the present disclosure.

Reference numerals in the accompanying drawings: 1. countertop; 11. spliced countertop panel; 12. mounting plate; 13. storage recess; 2. hook; 3. support adjustment assembly; 31. support rod; 32. movable adjustment rod; 33. abutting plate; 34. adjustment knob; 35. movable limiting block; 36. strap; 37. spring; 38. limiting tooth portion; 39. adjustment gear; 310. first rack; 311. second rack; 312. first mounting portion; and 313. second mounting portion.

DETAILED DESCRIPTIONS OF THE EMBODIMENTS

In order to enable those skilled in the art to better understand the technical solution of the present disclosure, the technical solutions in the embodiments of the present disclosure will be clearly and completely described below with reference to the accompanying drawings.

Obviously, the embodiments described are merely some, rather than all, of the embodiments of the present disclosure. Based on the embodiments of the present disclosure, all other embodiments obtained by those of ordinary skill in the art without creative effort shall fall within the scope of protection of the present disclosure.

It should be noted that, where no conflict exists, the embodiments of the present disclosure and the features and technical solutions in the embodiments may be combined with each other.

Embodiment 1

Figure 2:
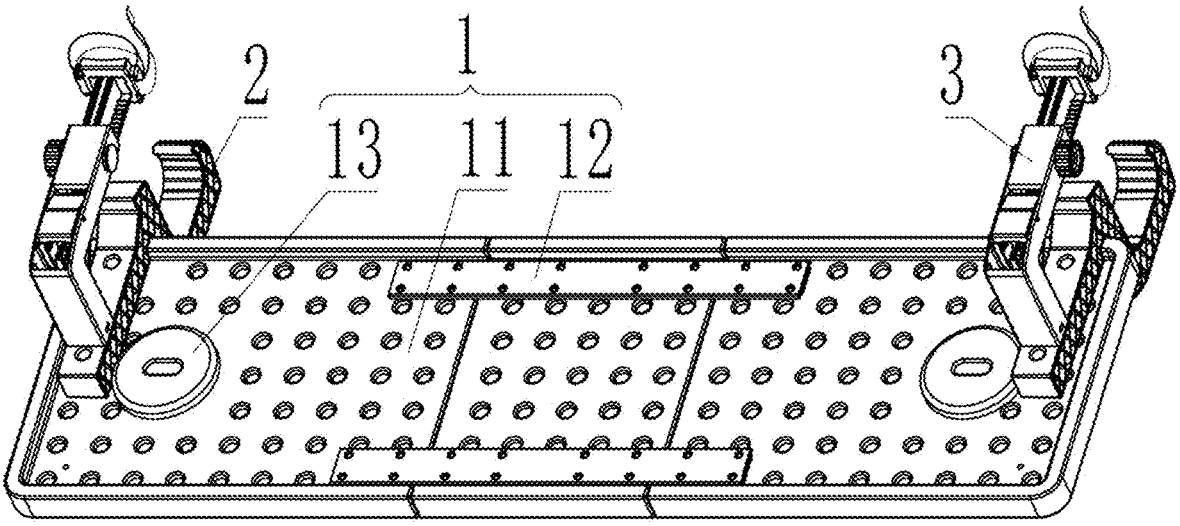
FIG. 2 is a second three-dimensional schematic structural diagram of the present disclosure.
Figure 3:
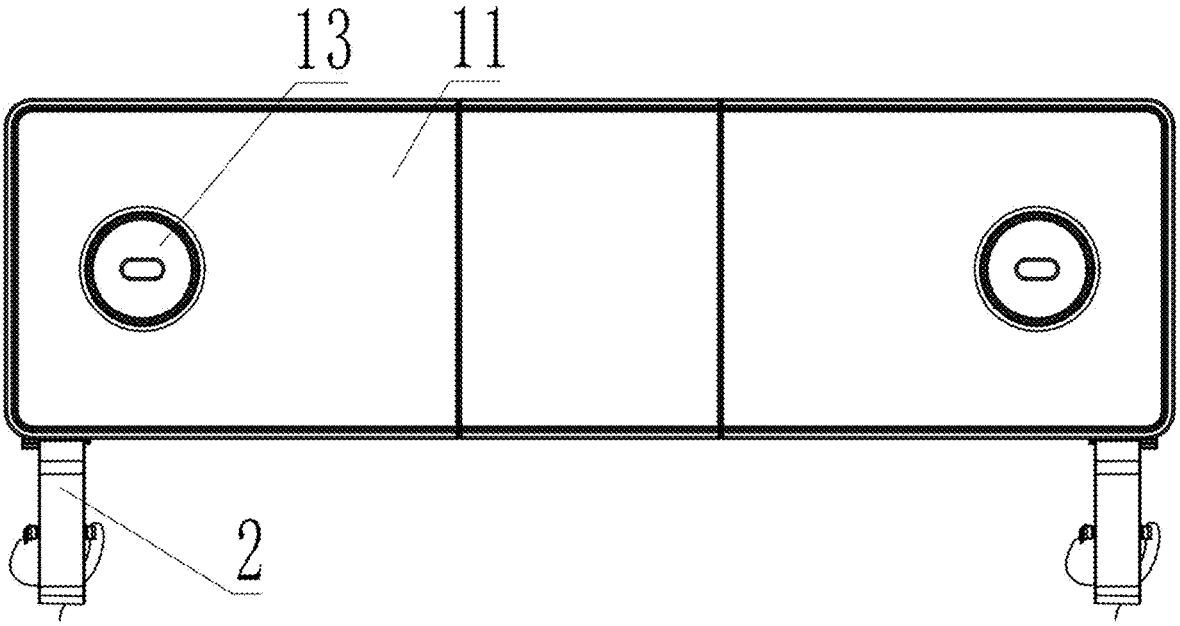
FIG. 3 is a schematic structural diagram of a top view of the present disclosure.
Figure 4:
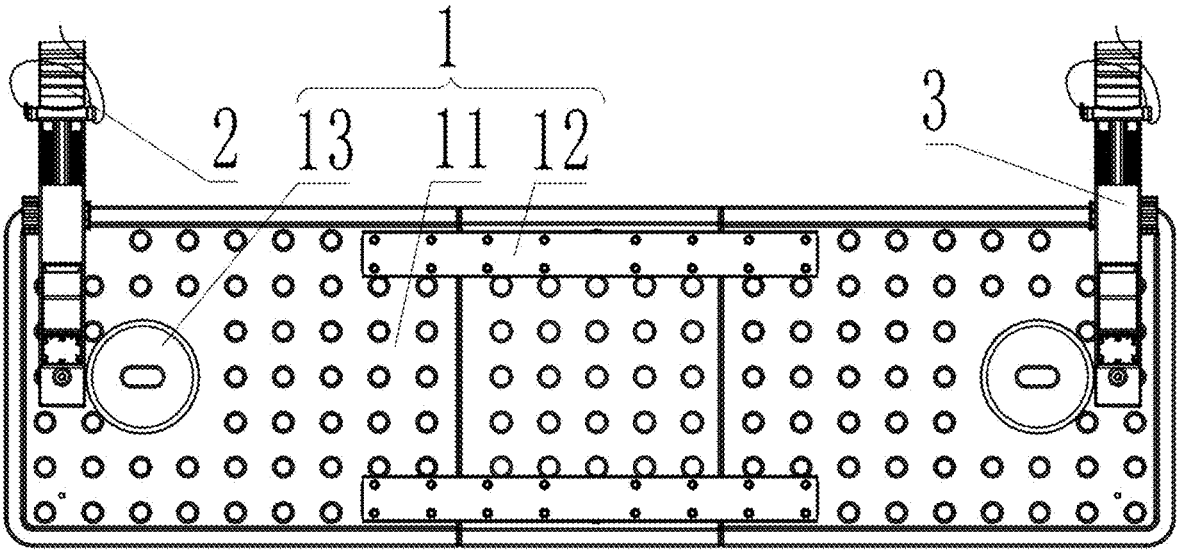
FIG. 4 is a schematic structural diagram of a bottom view of the present disclosure.
Figure 5:
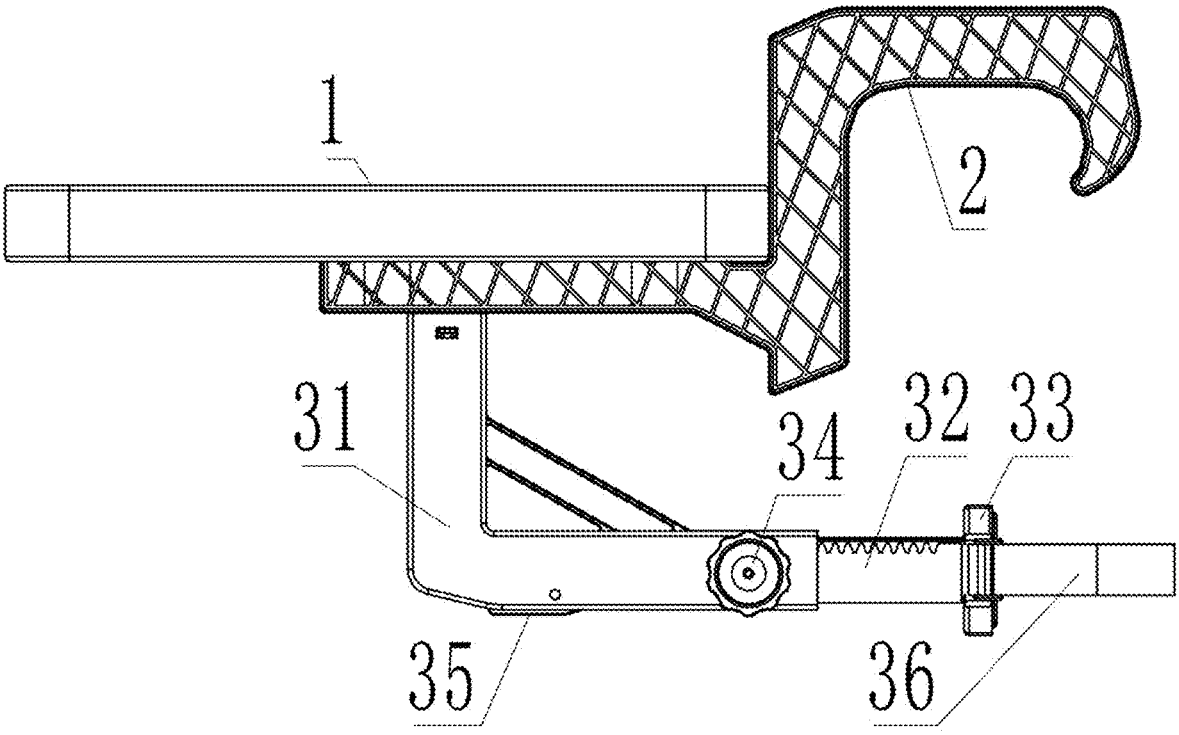
FIG. 5 is a schematic structural diagram of a side view of the present disclosure.
Figure 6:
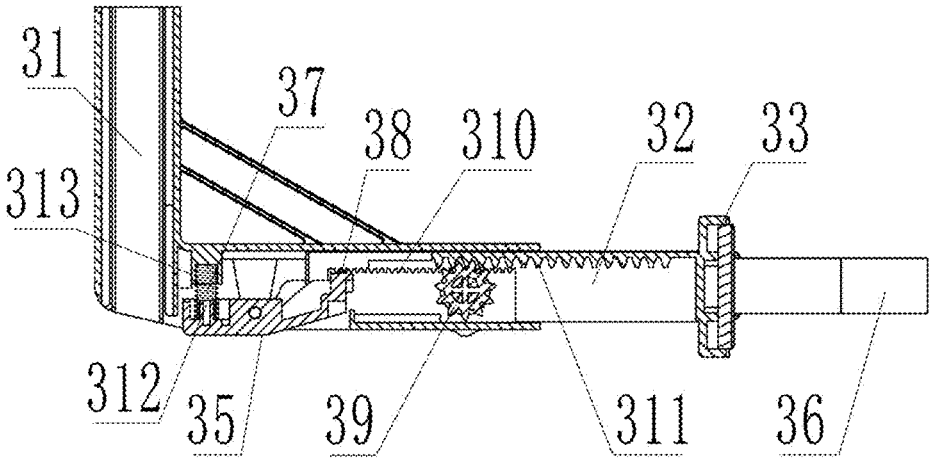
FIG. 6 is a schematic structural diagram of a side sectional view of a support adjustment assembly of the present disclosure.

As shown in FIGS. 1-6, a specific solution of this embodiment is as follows: a bar counter for an above-ground swimming pool, including hooks 2 symmetrically spaced apart on opposite sides of a countertop 1. Specifically, the countertop 1 is hung on an edge of the above-ground swimming pool via the hooks 2; a support adjustment assembly 3 is detachably mounted at a lower end of the hook 2, a movable adjustment rod 32 is slidably mounted on an inner side of the support adjustment assembly 3 in a linear direction, and a limiting portion cooperating with the movable adjustment rod 32 is disposed at an inner bottom of the support adjustment assembly 3; specifically, a length of the movable adjustment rod 32 extending from one side of the support adjustment assembly 3 is adjusted to abut against a side wall of the above-ground swimming pool until the countertop 1 is adjusted to a stable state; and the movable adjustment rod 32 is then locked by the limiting portion to maintain an installed state of the bar counter.

Embodiment 2

As shown in FIGS. 1-4, as a preferred embodiment of the above embodiment: the countertop is formed by a plurality of spliced countertop panels 11 assembled together on a horizontal plane. In this embodiment, the spliced countertop panels 11 are blow-molded panels, and are composed of two spliced countertop panels 11 on both sides and one middle spliced countertop panel 11 assembled together; and by providing the spliced countertop panels 11, the countertop 1 of the bar counter can be conveniently assembled and disassembled, thereby facilitating use.

Mounting plates 12 are mounted at intervals at a bottom of the countertop 1, and the mounting plates 12 cover splicing joints between adjacent spliced countertop panels 11. In this embodiment, the mounting plates 12 are elongated metal members to fix the spliced countertop panels 11. By providing the mounting plates 12, the spliced countertop panels 11 of the bar counter can be more stably supported, reducing the deformation of the countertop and making the countertop 1 more stable during use.

The spliced countertop panels 11 are provided with storage recesses 13. In this embodiment, the storage recesses 13 are respectively formed on upper end surfaces of the left and right spliced countertop panels 11, and a groove body of each storage recess 13 is adapted to a shape of a bottom of a water cup, and can be used for placing the water cup.

A top of the hook 2 may be C-shaped, T-shaped, or other shapes capable of being latched onto an edge of the swimming pool. In this embodiment, a C-shaped hook is used, and the support adjustment assembly 3 is detachably mounted at a lower end of a bottom of the C-shaped hook. Specifically, a C-shaped hook opening at the top of the hook can be conveniently and quickly hung on the edge of the swimming pool, and the bottom of the hook is fixedly connected to the support adjustment assembly 3 (the prior art, not shown in the figures) via an extending snap-fit structure.

Embodiment 3

As shown in FIGS. 1-6, as a preferred embodiment of the above embodiments, the support adjustment assembly 3 includes a support rod 31. The support rod 31 is L-shaped and hollow inside, a top of the support rod is fixedly connected to the snap-fit structure extending from the bottom of the hook 2, a movable adjustment rod 32 is slidably mounted inside a bottom of the support rod via a sliding groove, and one side of the movable adjustment rod 32 extends outward from the support rod 31 and is provided with an abutting plate 33 adapted to the side wall of the swimming pool. Through a shape of the support rod 31, the mounting of the movable adjustment rod 32, and the arrangement of the abutting plate 33, the bar counter can further facilitate cooperation among the support rod 31, the movable adjustment rod 32, and the abutting plate 33 to facilitate adjustment and installation.

The limiting portion includes a movable limiting block 35 disposed inside the bottom of the support rod 31 and pivotally mounted via a pivot shaft. A limiting tooth portion 38 is disposed at an upper end of one side of the movable limiting block 35, and a bottom of the movable adjustment rod 32 is provided with a first rack 310 adapted to the limiting tooth portion 38. Specifically, the movable limiting block 35 is controlled to rotate about the rotating shaft by pressing the movable limiting block, thereby controlling engagement and disengagement between the limiting tooth portion 38 and the first rack 310. When the limiting tooth portion 38 is engaged with the first rack 310, the movable limiting block 35 locks a sliding movement of the movable adjustment rod 32; and when the limiting tooth portion 38 is disengaged from the first rack 310, the movable limiting block 35 unlocks the sliding movement of the movable adjustment rod 32. By providing the limiting tooth portion 38 and the first rack 310, the bar counter can further conveniently control the locking and unlocking of the movable adjustment rod 32 via the movable limiting block 35.

An adjustment knob 34 is rotatably mounted on a side wall of the support rod 31. The adjustment knob 34 is connected to an adjustment gear 39 rotatably mounted inside the support rod 31. The adjustment gear 39 is rotatably mounted inside the support rod 31 via a rotating shaft. A second rack 311 adapted to the adjustment gear 39 is disposed at the bottom of the movable adjustment rod 32 along a side of the limiting tooth portion 38. Specifically, the adjustment gear 39 meshes with the second rack 311, and rotation of the adjustment knob 34 drives the adjustment gear 39 to rotate, thereby controlling the sliding movement of the movable adjustment rod 32, on which the second rack 311 is formed, within the sliding groove. By providing the adjustment knob 34, the adjustment gear 39, and the second rack 311, the bar counter enables a user to easily and precisely control an extension length of the movable adjustment rod 32, thereby further facilitating adjustment and control operations.

A side of the movable limiting block 35 away from the limiting tooth portion 38 is provided with a first mounting portion 312. A second mounting portion 313 is disposed at an upper portion inside the support rod 31 at a position corresponding to the first mounting portion 312. An elastic member is installed between the first mounting portion 312 and the second mounting portion 313. In this embodiment, the elastic member is a spring 37, the first mounting portion 312 is a mounting protrusion, and the second mounting portion 313 is a mounting recess. By providing the spring 37, when the movable limiting block 35 of the bar counter is pressed and rotated, the spring 37 is compressed; and when released, the spring 37 rebounds and pushes the movable limiting block 35 to rotate reversely, thereby automatically resetting, and further facilitating the adjustment operations of the bar counter.

A side of the abutting plate 33 away from the movable adjustment rod 32 is provided with a buffer pad, and a strap 36 is further mounted on the abutting plate 33. In this embodiment, the strap 36 is a hook-and-loop fastening strap. By providing the buffer pad and the strap 36, the strap 36 can be used to secure the abutting plate 33 through the movable adjustment rod 32 of the bar counter to a rod on the side wall of the above-ground swimming pool, thereby preventing the bar counter from being directly lifted upward and further improving the installation stability of the bar counter.

Specific working principle of the present disclosure is as follows:

When the bar counter is used, the spliced countertop panels 11 are first assembled to form the countertop 1. The bar counter is then hung on an edge of the above-ground swimming pool using the hooks 2. In this case, under the action of gravity, the abutting plate 33 on one side of the movable adjustment rod 32 is pressed against one side wall of the swimming pool. Subsequently, the movable limiting block 35 is pressed to release the lock of the ovable adjustment rod 32 by the limiting tooth portion 38. The adjustment knob 34 is then rotated to control the extension length of the movable adjustment rod 32 until the countertop is djusted to a horizontal state. The movable limiting block 35 is then released to reset and lock the ovable adjustment rod 32 again. Finally, the abutting plate 33 is secured using the strap 36, thereby completing the installation process of the bar counter. Throughout the above working process, by providing the support adjustment assembly 3, the limiting portion and other structures, the bar counter can cooperate with the hooks 2 on the countertop 1 to adjust the extension length of the movable adjustment rod 32 within the support adjustment assembly 3, such that the countertop can be stably mounted on above-ground swimming pools of different shapes and specifications, thereby achieving strong applicability. This effectively solves the problem in the prior art that existing swimming pool bar counter mounting mechanisms are not adjustable, and are difficult to adapt to various unique shapes of above-ground swimming pools, resulting in low applicability.

In the present disclosure, unless otherwise expressly specified and limited, the terms "mounted/mounting," "connected/connecting," "attached/attaching," "fixed/fixing," and the like should be interpreted in a broad sense. For example, they may refer to a fixed connection, a detachable connection, or an integral structure; they may refer to a mechanical connection, an electrical connection, or a communicative connection; they may refer to a direct connection or an indirect connection through an intermediate medium; and they may refer to communication inside two elements, or an interactive relation between two elements, unless otherwise explicitly specified. For those of ordinary skill in the art, the specific meanings of the terms described above in the present disclosure may be interpreted according to specific circumstances.

Obviously, the embodiments described above are merely some embodiments of the present disclosure, rather than all embodiments. The accompanying drawings illustrate preferred embodiments of the present disclosure but do not limit the scope of patent of the present disclosure. The present disclosure may be implemented in many different forms. On the contrary, these embodiments are provided to make the disclosure of the present disclosure more thorough and complete. Although the present disclosure has been described in detail with reference to the foregoing embodiments, those skilled in the art may still modify the technical solutions described in the specific embodiments or make equivalent substitutions for some of the technical features. Any equivalent structures made using the contents of the specification and drawings of the present disclosure, whether directly or indirectly applied in other related technical fields, shall fall within the scope of protection of the present disclosure.

What is claimed is:

1. A bar counter for an above-ground swimming pool, comprising hooks spaced apart on opposite sides of a countertop, wherein a support adjustment assembly is mounted at a lower end of the hook, a movable adjustment rod is slidably mounted on an inner side of the support adjustment assembly, and a limiting portion cooperating with the movable adjustment rod is disposed inside the support adjustment assembly;

wherein the support adjustment assembly comprises a support rod, the support rod is L-shaped and hollow inside, a top of the support rod is connected to the hook, a movable adjustment rod is slidably mounted inside a bottom of the support rod, and one side of the movable adjustment rod extends outward from the support rod and is provided with an abutting plate;

wherein the limiting portion comprises a movable limiting block disposed inside the bottom of the support rod and pivotally mounted via a pivot shaft, a limiting tooth portion is disposed at an upper end of one side of the movable limiting block, and a bottom of the movable adjustment rod is provided with a first rack adapted to the limiting tooth portion.

2. The bar counter for an above-ground swimming pool according to claim 1, wherein the countertop is formed by a plurality of spliced countertop panels assembled together on a horizontal plane.

3. The bar counter for an above-ground swimming pool according to claim 2, wherein mounting plates are mounted at intervals at a bottom of the countertop, and the mounting plates cover splicing joints between adjacent spliced countertop panels.

4. The bar counter for an above-ground swimming pool according to claim 3, wherein the spliced countertop panels are provided with storage recesses.

5. The bar counter for an above-ground swimming pool according to claim 1, wherein a top of the hook is C-shaped, and the support adjustment assembly is detachably mounted at a lower end of a bottom of the hook.

6. The bar counter for an above-ground swimming pool according to claim 1, wherein an adjustment knob is rotatably mounted on a side wall of the support rod, the adjustment knob is connected to an adjustment gear rotatably mounted inside the support rod, and a second rack adapted to the adjustment gear is disposed at the bottom of the movable adjustment rod along a side of the limiting tooth portion.

7. The bar counter for an above-ground swimming pool according to claim 6, wherein a side of the movable limiting block away from the limiting tooth portion is provided with a first mounting portion, a second mounting portion is disposed at an upper portion inside the support rod at a position corresponding to the first mounting portion, and an elastic member is installed between the first mounting portion and the second mounting portion.

8. The bar counter for an above-ground swimming pool according to claim 7, wherein a side of the abutting plate away from the movable adjustment rod is provided with a buffer pad, and a strap is further mounted on the abutting plate.

* * * * *